United States Patent [19]

Uesaki

[11] Patent Number: 4,928,040

[45] Date of Patent: May 22, 1990

[54] ULTRA VIOLET RAY GENERATOR BY MEANS OF MICROWAVE EXCITATION

[76] Inventor: Osamu Uesaki, 11-8, Kasukabe Higashi 5-chome, Kasukabe-shi, Saitama Prefecture, Japan

[21] Appl. No.: 228,043

[22] Filed: Aug. 4, 1988

[30] Foreign Application Priority Data

Aug. 7, 1987 [JP] Japan ..... 62-121264[U]

[51] Int. Cl.[5] ..... H05B 41/24

[52] U.S. Cl. ..... 315/248; 315/39; 313/113

[58] Field of Search ..... 315/39, 111.41, 236, 315/248, 267, 344; 313/110, 113; 350/1.1, 1.2, 1.3, 1.4; 362/263

[56] References Cited

U.S. PATENT DOCUMENTS 4,001,632 1/1977 Haugsjaa et al. ..... 315/248 X 4,223,250 9/1980 Kramer et al. ..... 315/248

*Primary Examiner*—David Mis

*Attorney, Agent, or Firm*—Wegner & Bretschneider

[57] ABSTRACT

A microwave generator for generating microwaves, a microwave cavity connected with the microwave generator, and a UV lamp disposed in the microwave cavity. A UV reflector is detachably secured near the UV lamp in the microwave cavity, the reflector consisting of a light-transmitting base and an interference film thereon, having a thickness of 2 to 2.2 microns, and the interference film being formed by vacuum-evaporating a first layer of zirconium oxide on the base, and subsequently the second layer of silicon oxide on the first layer, and repeating the vacuum evaporations. The UV reflector can be detached from the generator without changing the capacity of the microwave cavity, and thus becoming changable of only the directions or configurations of the UV without changing microwave efficiency of the microwave cavity, and furthermore, the generator can obtain the UV of low temperature, exclusive of infra red rays originally included in the UV.

4 Claims, 2 Drawing Sheets

ULTRA VIOLET RAY GENERATOR BY MEANS OF MICROWAVE EXCITATION

BACKGROUND OF THE INVENTION

1. Field of the Invention

The present invention relates to an ultra violet rays generator (UV generator) by means of microwaves exitation comprising a step of irradiating microwaves to an ultra violet rays lamp (UV lamp), such as an electrodeless lamp etc. in a microwave cavity, and more particularly, to a UV generator detachable of an ultra violet rays reflector (UV reflector) from focus ray type to parallel rays type etc., without changing the capacity of a microwave cavity (impedance), and thus, becoming changeable of rays, for example, from focus rays to parallel rays or contrary to this without changing microwave efficiency, and furthermore possible of obtaining UV of low temperature excluding infra red rays (IR), and thus, becoming possible of the irradiation in high efficiency to the substrates which are damaged by high temperature heat, such as plastics.

2. Description of the Prior Art

There are conventionally known UV generators, such as a UV generator shown in FIG. 3.

In FIG. 3, an upper part of the generator is omitted, which includes a microwave generator and a wave guide, because of the same as FIG. 1, and thus, the omitted part will be explanated with FIG. 1.

The UV generator shown in FIG. 3 consists of a microwave generator 1, a wave guide 2, both of them being shown in FIG. 1, a microwave cavity 3, and a UV lamp 4, both of them being shown in FIG. 3. In said generator, the microwaves 6 which are generated from a microwave antenna 5 of the microwave generator 1 are introduced into the microwave cavity 3 through a slot 8 bored in an upper wall 7 of the microwave cavity 3. At this time, the UV lamp 4 is irradiated and exited with the microwaves 6 to generate ulta violet (UV) 9. The obtained UV are reflected by a curved reflecting membrance 10 formed on the inner wall 3a of the microwave cavity 3, and then, are supplied to irradiate the substrate which are not shown in the drawings, through a mesh 11.

In said generator shown in FIG. 3, however, the direction of the reflected UV is usually invariable and the variation or change thereof is impossible since the reflecting membrance 10 is integrally formed with the wall of the microwave cavity 3. If the direction wants to be changed, the wall of microwave cavity 3 must be changed. This change of the wall will result in the change of the capacity (volume) of the microwave cavity 3, and as a result, the impedance of the microwaves and microwaves effeciency will be changed and thus, the UV having constant strength can not be obtained.

Furthermore, according to the generator shown in FIG. 3, the IR produced together with the UV and contained in the UV can not be excluded from the UV, and thus, the obtained UV are accompanied with heat, and accordingly, it is impossible to irradiate the UV to the substrates which hate high temperature heat.

SUMMARY OF THE INVENTION

It is an object of the present invention to provide a UV generator wherein the disadvantages found in the prior are overcome.

It is another object of the present invention to provide such a UV generator wherein it is detachable of only a UV reflector without changing the capacity of a microwave cavity (impedance), and thus becoming changeable of the direction of the UV without changing the microwave efficiency.

It is furthermore another object of the present invention to provide such a UV generator wherein it is possible of obtaining a UV of low temperature excluding IR.

According to the present invention, the above objects are accomplished by providing a UV generator by means of microwave exitation comprising a microwave generator for generating microwaves, a microwave cavity connected with said microwave generator, and an ultra violet rays (UV) lamp disposed in said microwave cavity, said microwaves generated from said microwave generator being introduced into said microwave cavity through a slot in an upper wall of said microwave cavity, and said ultra violet rays lamp in said microwave cavity being irradiated and exited with said microwaves to generate ultra violet rays, characterized in that an ultra violet rays reflector is detachably secured near said ultra violet rays lamp in said microwave cavity, said reflector consisting of a light-transmitting base and an interference film thereon, having a thickness of 2 to 2.2 microns, and said interference film being formed by vacuum-evaporating the first layer of zirconium oxide on the base and subsequently the second layer of silicon oxide on the first layer, and repeating said vacuum evaporations.

DETAILED DESCRIPTION

The present invention is illustrated in detail with the attached drawings.

Figure 3:
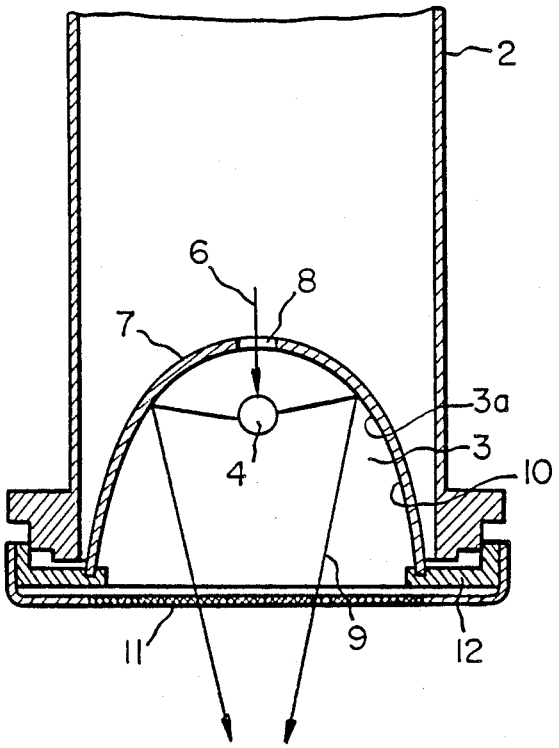
FIG. 3 PRIOR ART

The generator of the present invention comprises a microwave generator 1 for generating microwaves, a wave guide 2, a microwave cavity 3, and a UV lamp 4 as same as the prior generator shown in FIG. 3. The microwave generator 1 can be any type of prior arts, such as a fixed power type with permanent magnets. An electron tube is designated as an example of such type of microwave generator, in which a flow of electrons is controlled by magnetic fields added at right angels into coaxially radiated electric fields, and which is composed by disposing a cathode at a central part thereof, and an anode having even numbered resonance cavities at an outer circumference thereof. This type of electron tube works in such a manner that when high voltage is applied to the anode, the electrons from the cathode are discharged for the anode, and introduced to the strap (a space) situated at the top of cathode vanes with a gyrating movement by the power of the magnetic field (parallel to the cathode). At this place, the energy are supplied to the resonance cavities to generate microwaves. This microwaves are discharged into the wave guide 2 as the microwaves 6 from the microwave antenna 5 shown in FIG. 1.

The generated microwaves 6 are introduced into the microwave cavity 3 through a slot 8 bored in the upper wall 7 of the microwave cavity 3. At this time, the UV lamp 4 in the microwave cavity 3 is irradiated and exited with the microwave 6 to generate the UV 9.

Figure 1:
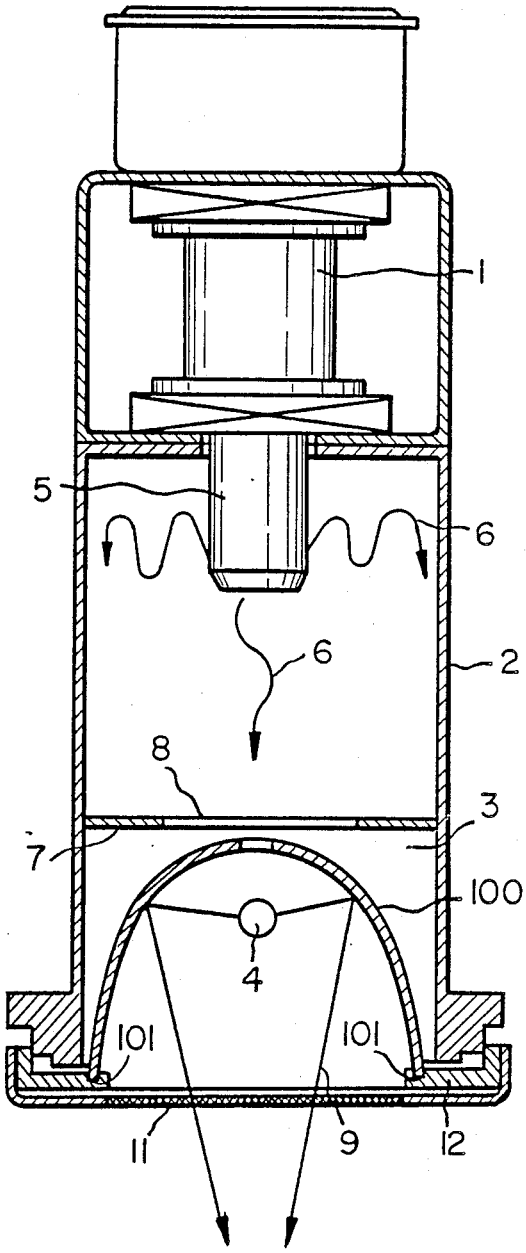
FIG. 1 shows a cross sectional view of one embodiment of the generator in accordance with the present invention.

The characteristic feature of the present invention resides in detachable securing an ultra violet rays (UV) reflector 100 near the UV lamp 4 in said microwave cavity 3, shown in FIG. 1.

The UV reflector 100 may be formed in the shape of a half-circle in the cross sectional view shown in FIG. 1, but it can be formed in another shapes freely in accordance with the desired directions or configurations of the rays to be reflected. Furthermore, it can be detachable secured, for example, by inserting the edges 101, 101 thereof into the bottom 12 of the microwave cavity 3 shown in FIG. 1.

Figure 2:
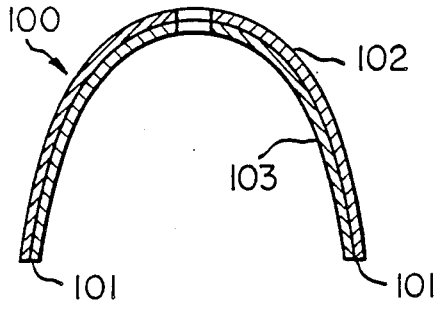
FIG. 2 shows a cross sectional view of one embodiment of the UV reflector used in the present invention, and, FIG. 3 shows a cross sectional view of one part of a prior art generator.

Furthermore, the UV reflector 100 is obtained by forming an interference film 103 on a light-transmitting base 102 shown in FIG. 2.

The light-transmitting base 102 consists of a heat-resisting base having light-transmitting characteristics, and the examples thereof are shown as quartz glass, Pyrex glass, etc..

The interference film 103 is an electrically insulating film having a thickness of 2 to 2.2 microns, preferably a thickness of 2.2 microns, which is obtained by vacuum-evaporating zirconium oxide as the first layer of an evaporation film on the base 102, and subsequently vacuumevaporating silicon oxide as the second layer of an evaporation film on the first layer, and repeating said steps of vacuum evaporations several ten times. The obtained interference film 103 has such characteristics that sparks with the microwaves 6 are very hard to occur, the rays of long wave length (Infra Red Rays (IR)) and electric waves are, respectively, passed therethrough, the energy of microwaves does not be absorbed thereinto, and the reflecting efficiency of the UV is very high.

The functions of the present invention are illustrated as follows.

According to the afore-mentioned generator of the present invention, the microwaves 6 of, for example, 2450 MHZ are, at first, generated from the microwave antenna 5 by the microwave generator 1. The generated microwaves 6 are efficiently introduced into the microwave cavity 3 through the wave guide 2 from the slot 8 of the upper wall 7, and in this microwave cavity 3, a UV lamp 4 is irradiated and exited with the microwaves 6 to generate UV 9. The obtained UV 9 are given to penetratively exclude infra red rays (IR) therefrom by the effect of the interference film 103 of the UV reflector 100, and to reflect only the residual UV in the main, and then, are supplied to irradiate the substrates which are not shown in the drawings through the mesh 11. The said UV are low temperature since it is given to exclude IR therefrom, which are originally included in the UV.

Moreover, the interference film 103 of UV reflector 100 are not given to spark with the microwaves 6 since it is made from an electrically insulating material.

Furthermore, the UV reflector 100 is detachable without changing the capacity of the microwave cavity 3 since it is detachably secured in the microwave cavity 3, different from the wall of the microwave cavity 3, and thus, the microwave efficiency are not changed at all even thought, for example, a focus type UV reflector 100 is substituted by a parallel type, and then, it can be possible of changing only the directions or configurations of the UV.

The effects of the present invention are illustrated as follows. The present generator is detachable of only the UV reflector without changing the capacity of the microwave cavity, and thus becoming changeable of the directions or configulations of the UV without changing the microwave efficiency of the microwave cavity, and furthermore, it can obtain the UV of low temperature, exclusive of infrared rays (IR) originally included in said UV.

What is claimed is:

1. An ultra violet ray generator using excitation of a UV lamp by microwaves comprising a microwave generator for generating microwaves, a microwave cavity connected with said microwave generator, and an ultra violet ray lamp disposed in said microwave cavity, said microwaves generated from said microwave generator being introduced into said microwave cavity through a slot in an upper wall of said microwave cavity, and said ultra violet ray lamp in said microwave cavity being irradiated and exited with said microwaves to generate ultra violet rays, wherein an ultra violet ray reflector is detachably secured near said ultra violet ray lamp in said microwave cavity, said reflector consisting of a light-transmitting base and an interference film thereon, and interference film having a thickness of 2 to 2.2 microns, said interference film being formed by vacuum-evaporating a first layer of zirconium oxide on the base and subsequently a second layer of silicon oxide on the first layer, and repeating said vacuum evaporations.

2. The generator as claimed in claim 1, wherein said light-transmitting base consists of a heat-resisting base having light-transmitting characteristics.

3. The generator as claimed in claim 1, wherein said vacuum-evaporations are repeated several ten times.

4. The generator as claimed in claim 1, wherein said interference film is an electrically insulating film.

* * * * *